US005400728A

United States Patent [19]

Zinssmeister

[11] Patent Number: 5,400,728

[45] Date of Patent: Mar. 28, 1995

[54] SEWING UNIT WITH A FEED DEVICE

[75] Inventor: Axel Zinssmeister, Rothselberg, Germany

[73] Assignee: G.M. Pfaff Aktiengesellschaft, Kaiserslautern, Germany

[21] Appl. No.: 128,342

[22] Filed: Sep. 28, 1993

[30] Foreign Application Priority Data

Oct. 16, 1992 [DE] Germany ..... 42 34 968.0

[51] Int. Cl.[6] ..... D05B 21/00

[52] U.S. Cl. ..... 112/121.15; 112/113

[58] Field of Search ..... 112/121.12, 121.11, 112/121.15, 104, 102, 113, 311

[56] References Cited

U.S. PATENT DOCUMENTS

| | | | |
|---|---|---|---|
| 4,563,960 | 1/1986 | Albrecht . | |
| 4,711,189 | 12/1987 | Müller et al. . | |
| 4,996,931 | 3/1991 | Mall | 112/121.15 X |
| 5,016,549 | 5/1991 | Sadlack et al. | 112/121.15 X |

FOREIGN PATENT DOCUMENTS

| | | |
|---|---|---|
| 0361640 | 4/1989 | European Pat. Off. . |
| 3406484C2 | 4/1986 | Germany . |
| 3607107C1 | 10/1987 | Germany . |

*Primary Examiner*—Clifford D. Crowder
*Assistant Examiner*—Paul C. Lewis
*Attorney, Agent, or Firm*—McGlew and Tuttle

[57] ABSTRACT

A sewing unit with a feed device for a fabric holder with support elements that can be moved along a guide and are connected to a drive each for feed means acting on the fabric holder. A fabric being sewn can be transported to or removed from the sewing machine by the feed device over any desired distance and the feed movement of the fabric being sewn can be brought about without problems during passage through the stitch formation site of the sewing machine even at very high stitch frequency because of the favorable dynamic properties. The guides are arranged in the same direction, and the support elements can be driven synchronously for a movement of the fabric holder in parallel to the guides, and at mutually different velocities for a movement in a direction deviating from the direction.

16 Claims, 2 Drawing Sheets

SEWING UNIT WITH A FEED DEVICE

FIELD OF THE INVENTION

The present invention pertains to a sewing unit with a feed device for a fabric holder with support elements that can be moved along a guide with feed means acting on the fabric holder.

BACKGROUND OF THE INVENTION

A sewing unit with a feed device for a fabric holder has been known from DE 36 07 107 C1. The feed device according to the exemplary embodiment shown in FIG. 3 of this patent has guides for accommodating support elements for guide rod mechanisms acting on the fabric holder, one of which is designed as a parallel guide rod mechanism, and another as a single guide rod mechanism. Each support element is connected to a stationary drive for movement along its guide.

If the guides are arranged nearly at right angles corresponding to the representations in FIG. 3 of the patent, the movement of the fabric holder, which must take place in the direction of extension of a guide, must be brought about by the drive that is associated with the support element that is displaceable on the guide alone, while the drive of the support element arranged on the other guide only guides a compensating movement toward the fabric holder. This leads to a high load of the first-named drive, on the one hand, and, on the other hand, to an unfavorable dynamic behavior of the feed device, especially at high stitch frequency, because the stitch-by-stitch acceleration as well as the deceleration of all movable parts must be ensured by a single drive.

In the above-described arrangement of the two guides in relation to one another, the range of movement of the fabric holder is influenced not only by the length of the guides, but by a plurality of other parameters as well, e.g., the length of the guide rod or the angle through which the guide rods are able to move. The range of movement of the fabric holder cannot consequently be extended as desired by extending the guides, but it can be extended only within the framework of the limits defined by the other elements of the feed device. Thus, even though such a feed device is suitable for moving a fabric to be sewn through the stitch formation zone of the sewing machine, it fails when the fabric to be sewn is additionally to be brought to the sewing machine from a remote insertion or preparation station or to a likewise remote removal or further processing station.

EP 0 361 640 A1 discloses a sewing unit with a feed device, which has a carriage, which is displaceable on rails and is provided with guides extending at right angles to the rails, on which guides support elements for arms acting on halves of the fabric holder are displaceably arranged. For feeding the carriage along the rails, the carriage is connected to a stationary drive. The movement of the support elements along the guides is brought about by a second drive carried by the carriage.

A fabric to be sewn can be transported by the feed device from an insertion station to the sewing machine and can be moved along the stitch formation site there. However, the carriage must be accelerated or decelerated together with the second drive arranged thereon during movements at right angles to the direction of extension of the carriage. Due to the relatively large mass of the carriage, which is caused by this drive, the feed device possesses poor dynamic properties. It is therefore unsuitable for use on modern sewing units which operate at very high stitch frequency during feed.

SUMMARY AND OBJECTS OF THE INVENTION

The primary object of the present invention is to further improve a feed device of this class such that it will be able to transport a fabric to be sewn to the sewing machine over any great distance desired or to remove it from the sewing machine, on the one hand, and, on the other hand, to generate the feed movement of the fabric being sewn without problems during the passage of the fabric through the stitch formation site of the sewing machine even at very high stitch frequency because of its favorable dynamic properties.

According to the invention, a sewing unit is provided with a feed device for a fabric holder. Support elements are provided which can be moved along a guide and are each connected to a drive. The guides are arranged running in the same direction. The support elements are provided such that they can be synchronously driven for moving the fabric holder in parallel to the guides and moving the support elements at different velocities for movement of the fabric holder in a direction deviating from the parallel direction.

Due to the guides being arranged in the same direction, the range of movement available for the support elements and consequently the maximum transport path of the fabric holder in the direction of extension of the guides depend only on the length of the guides. Consequently, by correspondingly dimensioning the guides, transport paths of any desired length can be covered on a sewing unit in order to feed a fabric being sewn from an insertion or preparation station to the sewing machine and from the sewing machine to a removal or further processing station. The size of the area of work, in which the stitch formation takes place, can be selected as desired in the direction of extension of the guides.

If the drives for generating the feed movement of the fabric holder in the direction of extension of the guides move in the same direction, the force to be generated for acceleration and deceleration is distributed among all the drives involved. Consequently, since these are operated under partial load only, excess force can be kept ready for the acceleration phase or the deceleration phase in order to overcome these phases as quickly as possible and to achieve an advantageous dynamic behavior of the feed device as a result.

In the case of drives operating with different directions and/or amounts of action for bringing about a feed movement of the fabric holder in a direction deviating from the direction of extension of the guides, the movement to be performed by each of these drives is only part of the drive movement to be provided as a whole for the feed movement, and the distribution of the drive movement among the individual drives depends on both the starting position of the guide rod mechanisms at the beginning of the feed movement and the direction and amount of deflection of the guide rod mechanisms during the feed movement. Due to the resulting, relatively small amounts of movement of the individual drives, an advantageous dynamic behavior is obtained for the feed device.

Due to the good dynamic behavior of the feed device in any direction of feed, the fabric holder can be moved through the stitch formation site at very high stitch frequency.

Feed means is provided with a parallel guide rod mechanism and a single guide rod mechanism wherein both guide rod mechanisms are connected at one end to one of the support elements and at the other end to the fabric holder in a hinge-like manner. This allows the fabric holder to be guided by the guide rod mechanisms with a minimum technical effort. The single guide rod mechanism preferably acts on the fabric holder via one guide rod of the parallel guide rod mechanism.

The guides for the support elements are arranged on a side of the sewing machine that is away from the user. This insures that the access to the sewing machine is not hindered, despite the fact that the sewing unit is equipped with a feed device.

The support elements are preferably arranged on a common guide. This makes it possible to preset the path of movement of a plurality of support elements, using the minimum number of components.

The guides are arranged pivotably in relation to the support plate for the fabric to be sewn. The support elements are accommodated non-rotatably on the guides. With this structure, the fabric holder can be lifted off from the support plate for the fabric to be sewn due to the pivotable arrangement of the guides. The guides are preferably pivotably attached to a support which is arranged pivotably in relation to the support plate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
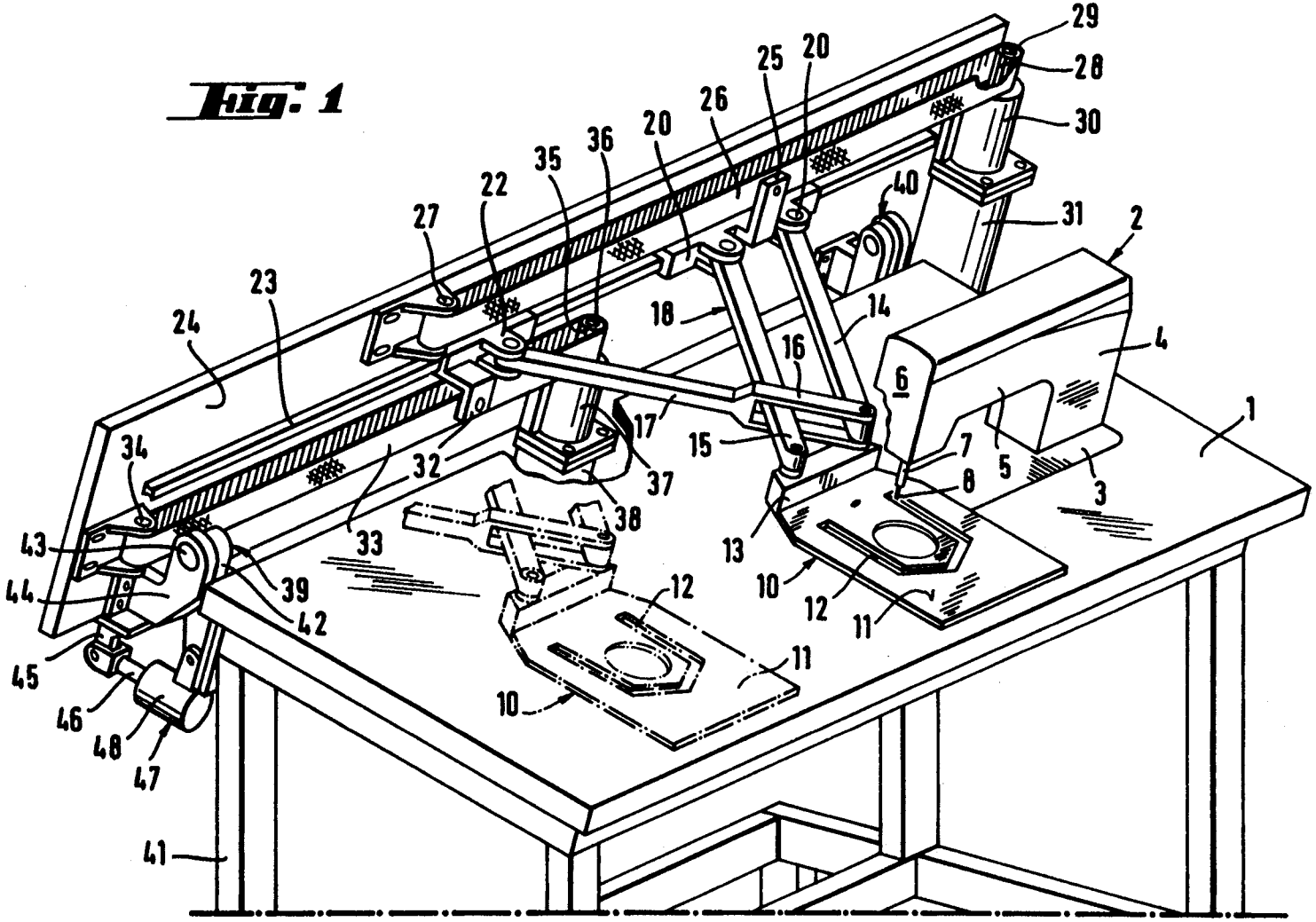
FIG. 1 is a perspective front view of a sewing unit.

A sewing machine 2, which is formed by a base plate 3, a stand 4, an arm 5, and a head 6, is arranged on a support plate 1 of a sewing unit. A needle bar 7, which is driven in the known manner and carries a needle 8, is arranged in the head 6.

The fabric to be sewn is accommodated by a fabric holder 10, which has a plate 11 grasping the fabric to be sewn in a frictionally engaged manner and is provided with an opening 12 corresponding to the shape of the seam for the passage of the needle 8. The plate is attached to a bracket 13, on which two guide rods 14, 15 of equal length, which extend in parallel, act, and which is also acted on at the linkage point of the guide rod 14 by a fork-shaped end 16 of another guide rod 17, which end enables the guide rod 15 to pass through. The guide rods 14, 15 and 17 form a feed means connected to the fabric holder for acting on the fabric holder.

Figure 2:
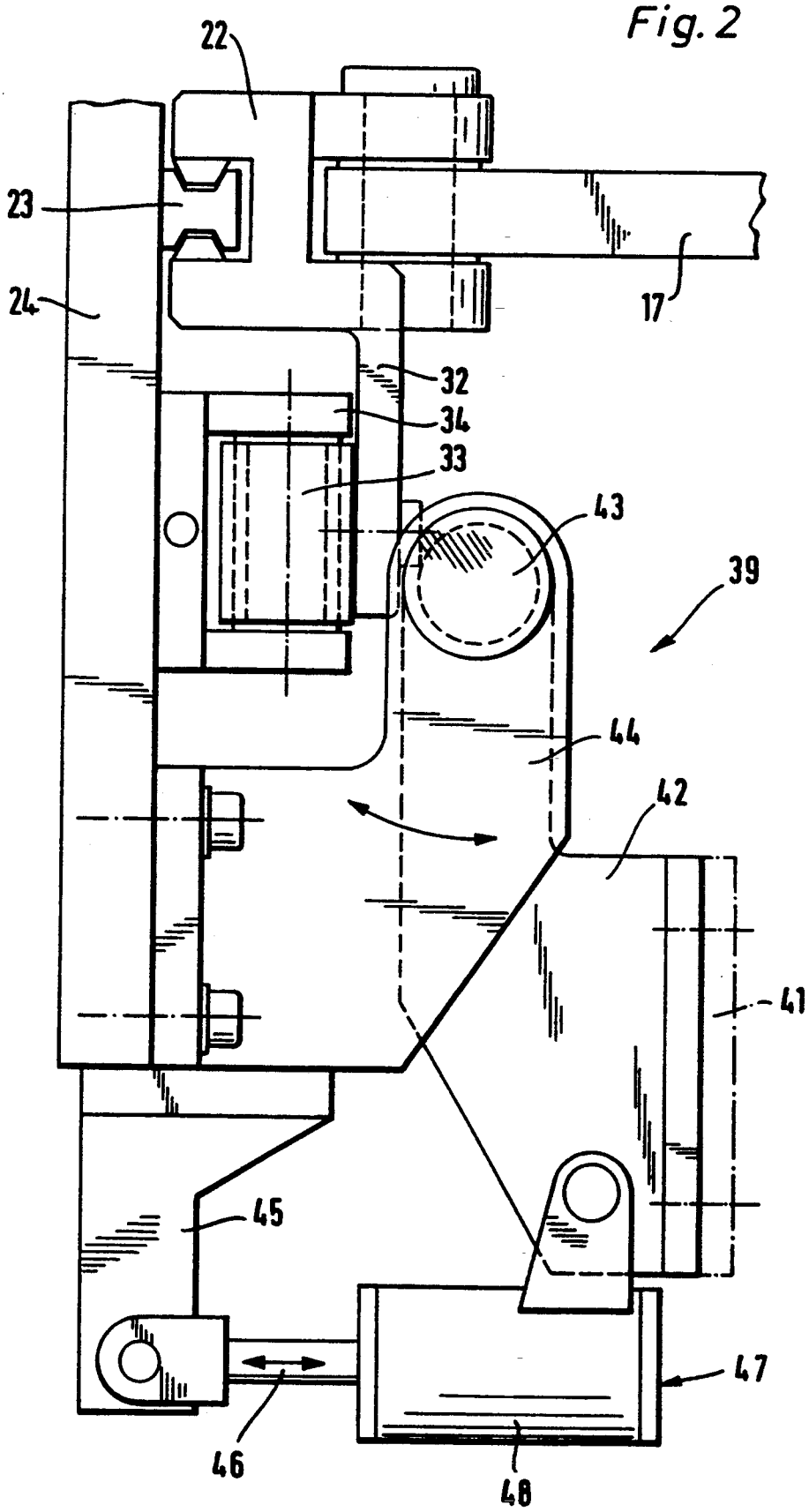
FIG. 2 is a side view of an enlarged partial area of this sewing unit.

The guide rods 14 and 15, which form a parallel guide rod mechanism 18, are accommodated on a common support element 20, whereas the guide rod 17, which forms a single guide rod mechanism, is accommodated on a support element 22. The support elements 20 and 22 are either arranged displaceably on a guide 23 forming part of a guide means, in which case the support elements 20 and 22 extend in the same direction, or, as will be described below, they are arranged displaceably on a common guide 23. The guide 23, which is attached to a plate-shaped guide means support 24 provided on the rear side of the support plate 1, is designed as a guide of a double-T cross section (FIG. 2). The support elements 20 and 22 are arranged on the guide 23 in a nontwisting manner due to the support elements 20 and 22 being designed in a positive-locking manner with the guide 23.

The support element 20 of the parallel guide rod mechanism 18 is attached via a strap 25 to a toothed belt 26, which extends above the guide 23, is guided via a deflecting element 27 provided with a deflecting roller at one end and via a pinion 28 at the other end, wherein the pinion 28 is rigidly connected to a shaft 29 of a gear mechanism 30 attached to the support 24. A drive 31 is flanged onto the gear mechanism 30.

The support element 22 of the guide rod 17 is attached to a second toothed belt 33, which extends below the guide 23 and is also guided via a deflecting roller of a deflecting element 34 at one end and via a pinion 35 at the other end, wherein the pinion is rigidly connected to a shaft 36 of a second gear mechanism 37 attached to the support 24. A drive 38 is flanged onto this gear mechanism as well.

The support 24 is connected via hinge connections 39, 40 to a frame 41 accommodating the support plate 1. The hinge connection 39 shown on a larger scale in FIG. 2 has, for attachment to the frame 41, a holding leg 42, at the free end of which a pin 43 for pivotably accommodating an oscillating lever 44 is provided. The oscillating lever 44 is attached at the other end to the holder 24, which is provided on its underside with a projection 45, on which the piston rod 46 of a double-acting compressed-medium cylinder 48, which acts as a motor operator 47 and is pivotably mounted on the holding leg 42, acts in a hinged manner. The compressed-medium cylinder 48 can be connected to a source of compressed medium via a 4/2-way valve, which is commercially available and therefore is not represented.

The sewing unit, whose mode of operation will be explained below, is used, e.g., for sewing pockets onto pieces of clothing. In its starting position indicated by dash-dotted lines in FIG. 1, the fabric holder 10 is to be lowered onto a positioned fabric to be sewn with aligned pocket, while the opening 12 in the plate 11 must be at the location at which the seam will be formed. To lower the fabric holder 10, the compressed-medium cylinder 48 is switched on for extending the piston rod 46, and the support 24 is pivoted as a result clockwise according to FIGS. 1 and 2 around the pins 43 at the holding legs 42 of the hinge connections 39 and 40. Due to the positive-locking connection between the support elements 20 and 22 and the guide 23, the support elements and consequently the guide rods 14, 15, and 17, as well as the fabric holder 10 participate in this pivoting movement.

To transport the fabric being sewn exclusively in the direction of extension of the guide 23 into the sewing position indicated by solid lines in FIG. 1, the drives 31 and 38 are switched on and are controlled, in terms of both their direction of action and their amount of action, such that the support element 20 of the parallel guide rod mechanism 18, which support element 20 is connected to the first drive 31 via the toothed belt 26, is displaced in the same direction and at the same velocity as the support element 22 of the guide rod 27 connected to the second drive 38 via the toothed belt 33 along the guide 23. Based on the resulting synchronous movements of the two drives 31 and 38, these must be operated under partial load only.

When the fabric holder 10 has reached its sewing position, a feed movement at right angles to the direction of extension of the guide 23 must be transmitted to move the fabric holder 10 corresponding to the course of the seam prepared, in addition to the feed movement in the direction of extension of the guide 23. To do so, the drives 31 and 38 are operated by different amounts of action (such as different velocities), and sometimes even in mutually opposite directions of action, and a change in the distance between the support element 20 of the parallel guide rod mechanism 18 and the support element 22 of the connection rod 17 is achieved as a result. This change in distance brings about a change in the angular position between the guide rods 14, 15 of the parallel guide rod mechanism 18 and the guide rod 17, as a result of which a movement with a component directed at right angles to the guide 23 is transmitted to the fabric holder 10.

Since the relative movement between the support members 20 and 22 is determined by a movement component of both the support member 20 and of the support element 22, the drives 31 and 38 must generate only the movement component associated with the corresponding support element 20 or 22. As a result, the amounts of action to be generated by the drives 31 and 38 are relatively small.

When seam formation has concluded, the fabric holder 10 is moved from the sewing position into removal position, which may be any desired position and is therefore not shown. The piston rod 46 of the compressed-medium cylinder 48 is withdrawn by operating the compressed-medium cylinder 48, so that the piston rod 46 brings about a pivoting movement of the support 24 according to FIGS. 1 and 2 in the counterclockwise direction around the pins 43 of the holding legs 42 of the hinge connections 39 and 40. The fabric being sewn is released as a result and can be removed.

The drives 31 and 38 are operated thereafter such that the fabric holder 10 is returned in the raised position into the starting position indicated by dash-dotted lines in FIG. 1, in which it can be lowered onto an already positioned, new fabric to be sewn.

While a specific embodiment of the invention has been shown and described in detail to illustrate the application of the principles of the invention, it will be understood that the invention may be embodied otherwise without departing from such principles.

What is claimed is:

1. A sewing unit and feed device, comprising:

a sewing machine;

a fabric holder;

feed means connected to said fabric holder for acting on said fabric holder;

support elements connected to said feed means;

guide means providing a guide path extending in the same direction for each of said support elements, for guiding said support elements; and drive means including a drive connected to each support element for independently moving each support element back and forth along said guide path for moving said support elements synchronously for moving said fabric holder in parallel to said guide path and for moving said support elements at different velocities for moving said fabric holder in a direction different from a direction parallel to said guide path.

2. A sewing unit according to claim 1, wherein:

said feed means includes a parallel guide rod mechanism and a single guide rod mechanism, said parallel guide rod mechanism being connected to one of said support elements at one end and being connected to said fabric holder at another end in a hinge like manner and said single guide rod mechanism being connected at one end to another of said support elements and being connected at another end to said fabric holder in a hinge-like manner.

3. A sewing unit according to claim 2, wherein:

said single guide rod mechanism acts on said fabric holder via a guide rod of said parallel guide rod mechanism.

4. A sewing unit according to claim 1, wherein:

said guide means is arranged on a side of said sewing machine opposite an operator side of said sewing machine.

5. A sewing unit according to claim 1, wherein:

said support elements are arranged on a common guide, said common guide forming said guide means.

6. A sewing unit according to claim 1, further comprising:

a sewing unit support plate for fabric to be sewn, said guide means being arranged pivotably connected to said support plate, said support elements being accommodated non-rotatably on said guide means.

7. A sewing unit according to claim 6, wherein: said guide means is attached to a guide means support, said guide means support being pivotably connected to said sewing unit support plate.

8. A sewing unit and feed device, comprising:

a sewing machine;

a sewing unit support plate for fabric to be sewn;

a fabric holder;

feed means connected to said fabric holder for acting on said fabric holder;

support elements connected to said feed means;

guide means providing a guide path extending in the same direction for each of said support elements, for guiding said support elements; and drive means including a stationary drive connected to each support element for independently moving each support element back and forth along said guide path for moving said support elements synchronously for moving said fabric holder in parallel to said guide path and for moving said support elements at different velocities for moving said fabric holder in a direction different from a direction parallel to said guide path.

9. A sewing unit according to claim 8, wherein:

said feed means includes a parallel guide rod mechanism and a single guide rod mechanism, said parallel guide rod mechanism being articulated to one of said support elements at one end and being articulated to said fabric holder at another end and said single guide rod mechanism being articulated to another of said support elements and being articulated at another end to said fabric holder.

10. A sewing unit according to claim 9, wherein:

said single guide rod mechanism acts on said fabric holder via a guide rod of said parallel guide rod mechanism.

11. A sewing unit according to claim 8, wherein:

said guide means is arranged on a side of said sewing machine opposite an operator side of said sewing machine.

12. A sewing unit according to claim 8; wherein:

said support elements are arranged on a common guide, said common guide forming said guide means.

13. A sewing unit according to claim 8, further comprising:

a guide means support, said guide means support being arranged adjacent to said sewing unit support plate, pivotably attached to said sewing unit support plate, said support elements being accommodated non-rotatably on said guide means.

14. A sewing unit and feed device, comprising:

a sewing machine;

a sewing unit support plate for fabric to be sewn;

a fabric holder;

feed means connected to said fabric holder for acting on said fabric holder;

support elements connected to said feed means;

guide means providing a guide path with two guide directions for guiding said support elements along said guide path;

a guide means support, said guide means support being pivotably connected to said sewing machine support plate; and drive means including a drive connected to each support element for independently moving each support element back and forth along said guide path for moving said support elements synchronously for moving said fabric holder in parallel to said guide path and for moving said support elements at different velocities for moving said fabric holder in a direction different from a direction parallel to said guide path.

15. A sewing unit according to claim 14, wherein:

said feed means includes a parallel guide rod mechanism and a single guide rod mechanism, said parallel guide rod mechanism being articulated to one of said support elements at one end and being articulated to said fabric holder at another end and said single guide rod mechanism being articulated to another of said support elements and being articulated at another end to said fabric holder.

16. A sewing unit according to claim 15, wherein:

said single guide rod mechanism acts on said fabric holder via a guide rod of said parallel guide rod mechanism.

* * * * *